United States Patent [19]

Truzzi et al.

[11] 4,437,299

[45] Mar. 20, 1984

[54] APPARATUS FOR JOINING TEXTILE THREADS WITH THE AID OF COMPRESSED AIR

[75] Inventors: Ferdinando Truzzi; Mauro Premi, both of Salo' , Italy

[73] Assignee: Mesdan S.p.A., Salo' , Italy

[21] Appl. No.: 387,147

[22] Filed: Jun. 10, 1982

[30] Foreign Application Priority Data

Jun. 16, 1981 [IT] Italy ..... 22356 A/81

[51] Int. Cl.[3] ..... B65H 69/06

[52] U.S. Cl. ..... 57/22; 57/261

[58] Field of Search ..... 57/22, 23, 261, 264; 73/160

[56] References Cited

U.S. PATENT DOCUMENTS

| | | | |
|---|---|---|---|
| 3,220,758 | 11/1965 | Raasch et al. | 73/160 X |
| 3,572,025 | 3/1971 | Irwin | 57/22 |
| 3,581,486 | 6/1971 | Dibble | 57/22 |
| 4,178,749 | 12/1979 | Stahlecker | 57/263 |
| 4,217,749 | 8/1980 | Rohner et al. | 57/22 X |
| 4,240,247 | 12/1980 | Matsui et al. | 57/22 X |
| 4.314,437 | 2/1982 | Rohner et al. | 57/22 |

*Primary Examiner*—Donald Watkins

*Attorney, Agent, or Firm*—Cushman, Darby & Cushman

[57] ABSTRACT

In an apparatus for joining textile threads with the aid of compressed air, there is provided a device for checking the tearing strength of the joint zone of the threads before their extraction from the apparatus. The device comprises at least one mobile member arranged to act on the loop formed by the joined threads with a predetermined traction force at an intermediate point between the points at which the threads are locked at the apparatus inlet. Control means are provided which are operated so that they travel through a predetermined outward and return stroke and act on said mobile member by way of a yieldable coupling which is set to yield when the predetermined traction force is exceeded.

8 Claims, 4 Drawing Figures

APPARATUS FOR JOINING TEXTILE THREADS WITH THE AID OF COMPRESSED AIR

DESCRIPTION

Figure 1:
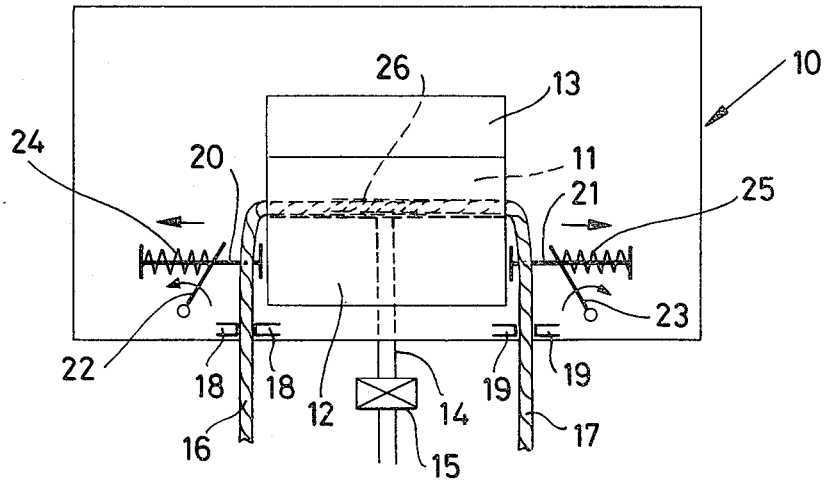

This invention relates to an apparatus for joining textile threads with the aid of compressed air.

Apparatus of this type have become of widespread use in recent times, and have at least partly replaced conventional knotting devices. The advantage of said apparatus over knotting devices is that textile threads are joined together without the formation of a knot, by simply mixing and interlacing their fibres under the action of a burst of compressed air fed into a mixing chamber in the apparatus in which the joint is made.

However, the operation involved in joining textile threads only with the aid of compressed air is a very delicate one, the proper result of which depends on a large number of factors which are not easily determinable. The result of the operation is decidedly influenced by the perfect positioning of the threads to be joined within the mixing chamber, the length of their free ends, the duration of the burst of compressed air and many other factors. However there are also variable factors which are difficult to control such as the textile characteristics of the threads, which are often not perfectly constant.

By careful study of these phenomena it has been possible to conceive apparatus having a high degree of reliability and safety which enable the joining operation to be carried out with good repeatability, but which for imponderable reasons still with a certain frequency form joints which are not perfect or which have even not succeeded.

Joining apparatus of this type are constructed not only in a manually controlled version, but also in an automatically controlled version which enables the apparatus to be mounted directly on automatic winding machines (see for example British Pat. No. 1,121,597 and U.S. Pat. Nos. 4,217,749 and 4,232,509).

Whereas the proper success of the joint can be checked by the operator in manually controlled apparatus, this check cannot be made in the case of apparatus mounted on automatic winding machines, with the result that the use of checking devices has been proposed (see for example British Pat. No. 2,039,969 and German Patent No. 2 902 988). However, in both cases a rather serious drawback is that the joint obtained can appear successful and in order, whereas in reality the joint zone can have insufficient tearing strength. In this case, the joined thread is sent ahead with weakened zones which can cause thread breakage during the further working of the thread.

The object of this invention is to provide an apparatus for joining textile threads with the aid of compressed air which gives absolute assurance that each thread joined in the apparatus and extracted from it has a minimum determined tearing strength in its joint zone.

To attain this object, the present invention provides an apparatus of the aforesaid type, comprising a mixing chamber, means for feeding a burst of compressed air into said chamber for a predetermined time, and means which during the joining operation lock the threads to be joined at the points in which they enter the apparatus, characterised by incorporating a device for checking the tearing strength of the joint zone of the two threads comprising at least one mobile member arranged to act on the loop formed by the joined threads with a predetermined traction force at an intermediate point between the locking points at the apparatus inlet, control means for said mobile member which are operated so that they travel through a predetermined outlet and return stroke, and a yieldable coupling disposed between said mobile member and said control means, said coupling being set to yield when said predetermined traction force is exceeded.

By providing this checking device in the joining apparatus it is possible to check the tearing strength of the joint zone produced at the end of each operation involving the joining of two threads while these are still locked at the respective apparatus inlet points and before the joined threads are extracted from the apparatus. If this strength is equal to or greater than a predetermined value, i.e. if the joint formed by the two threads is perfect, the mobile member remains at rest and said control means can carry out their predetermined stroke by way of the yieldable coupling. In contrast, if the traction resistance of the joint zone does not reach the predetermined value, the control means by way of the yieldable coupling, which in this case does not yield, transmit their movement to the mobile member so that this carries out a determined stroke in order to tear the joint zone.

It is important that in this case the mobile member carries out a stroke which is sufficient to reliably pull apart the two threads which have not been perfectly joined. In this respect, if this stroke were to be too small, the joint zone of the two threads could be only partly torn and elongated without a clear separation of the two threads taking place, thus further weakening the joint zone which was previously not able to withstand the predetermined traction force.

It is precisely for this reason, i.e. to obtain reliable separation of the two threads if their joint is imperfect, that it is advantageous to provide two mobile members with respective control means and yieldable couplings which can act at two different points on the loop formed by the joined threads between their locking points at the apparatus inlet. In this manner, the stroke of each mobile member can be halved with a corresponding reduction in the necessary space.

In an advantageous embodiment, the mobile member designed to exert the predetermined traction force on the loop formed by the joined threads can consist of a hook carried by a swivel-mounted lever on which the control means act by way of the yieldable joint. Said swivel-mounted lever is advantageously positioned on the apparatus such that its hook acts on the thread in the vicinity of its exit from the mixing chamber.

The checking device according to the present invention can be fitted either to manually controlled apparatus or to automatically controlled apparatus, although its application is more opportune in this latter case, and it can also be used independently of the manner in which the threads to be joined together are inserted into the apparatus, i.e. whether the threads are inserted both from the same side of the apparatus or one from one side and the other from the other side.

Figure 2:
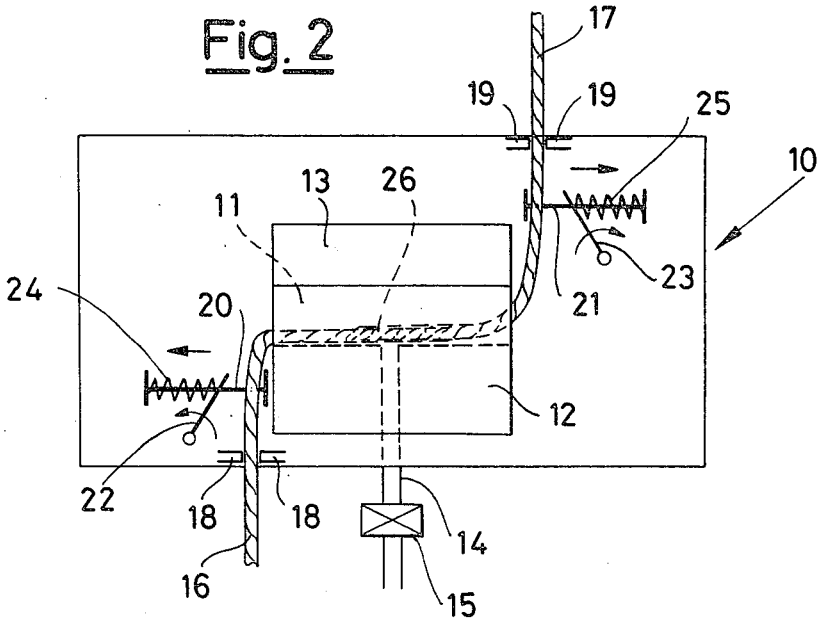
Figure 3:
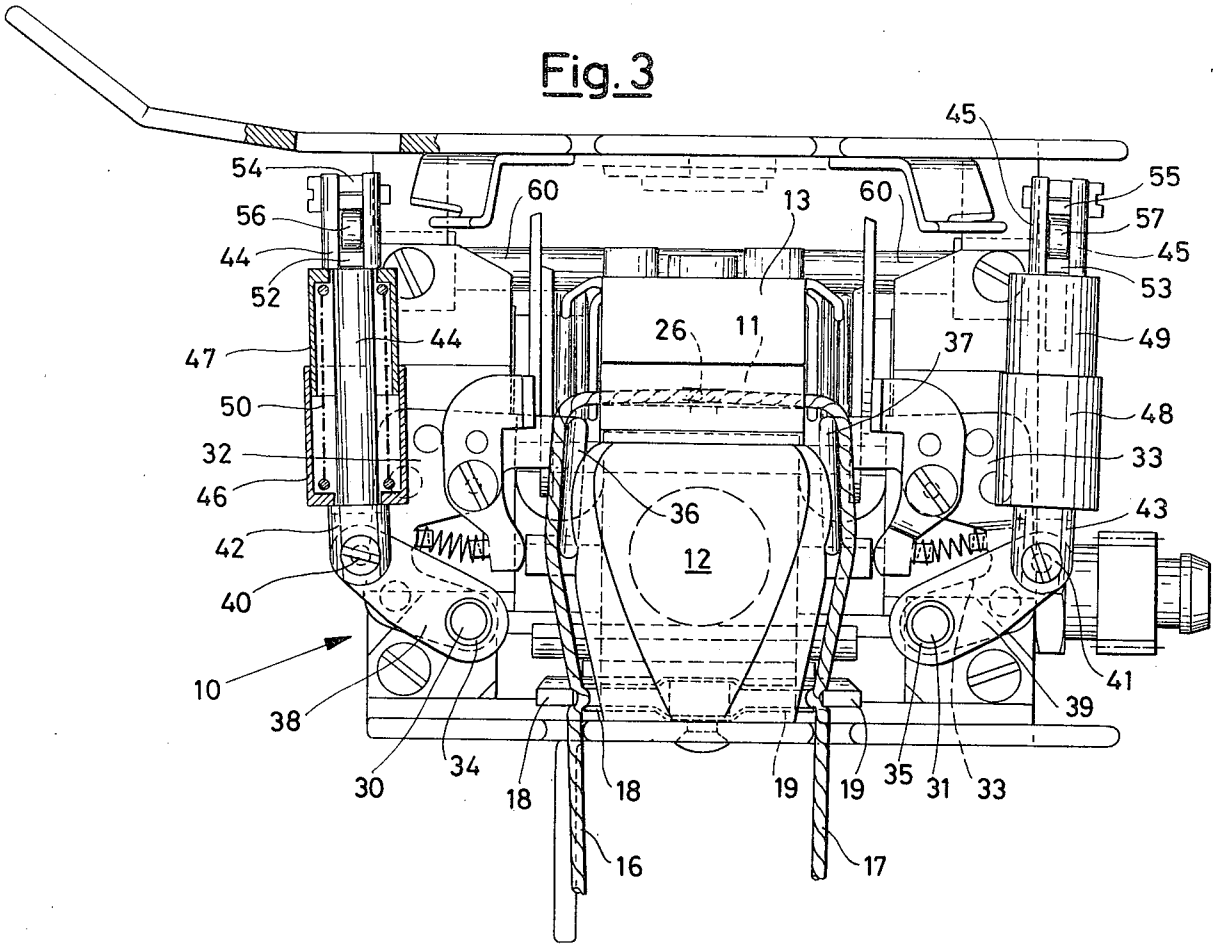
Figure 4:
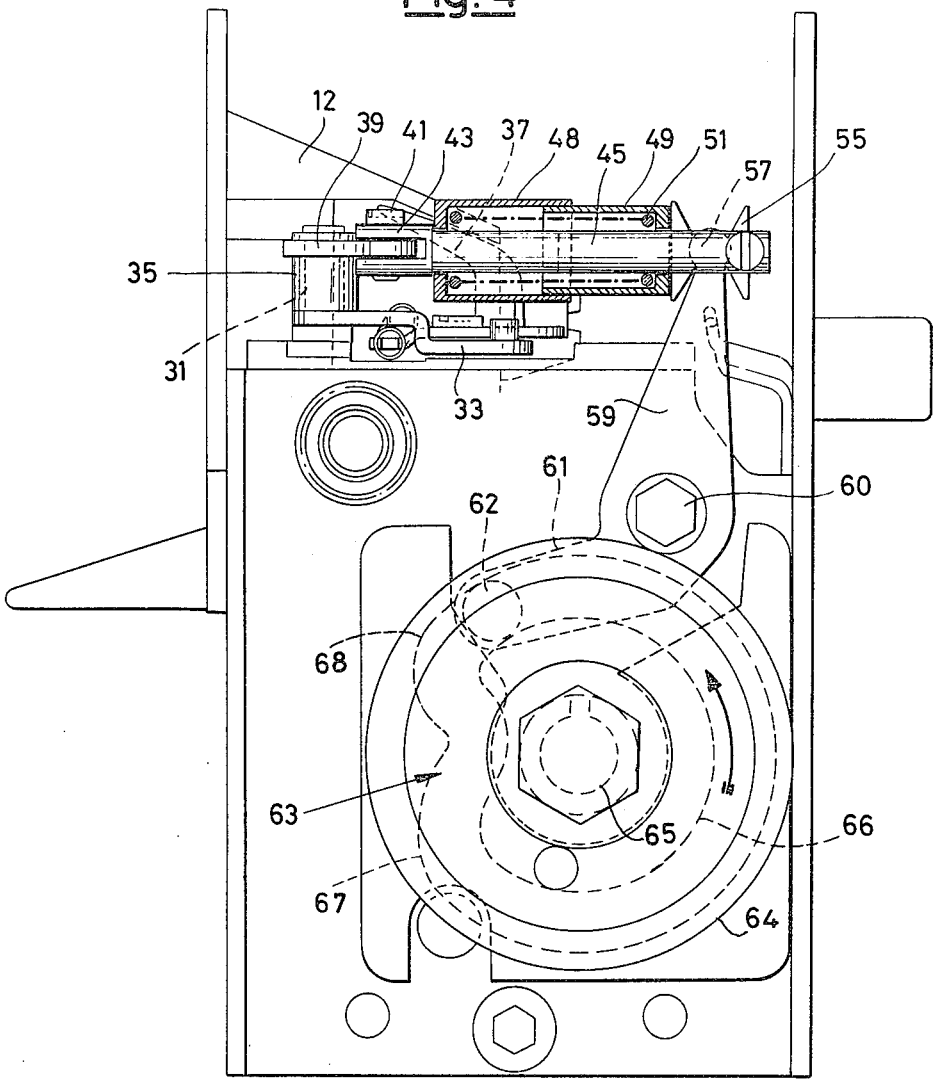

The structural and operational characteristics and the advantages deriving therefrom will be apparent from the detailed description of the invention given hereinafter with reference to the accompanying drawings in which:

FIG. 1 is a diagrammatic front view of an apparatus with the joined threads entering from the same side, FIG. 2 is a diagrammatic front view of an apparatus with the joined threads entering from opposite sides, FIG. 3 is a front view of an apparatus of the type illustrated in FIG. 1, and FIG. 4 is a side view of the apparatus illustrated in FIG. 3.

The apparatus for joining textile threads with the aid of compressed air to which the invention relates is well known in the art and thus only those parts which directly concern the invention are illustrated on the accompanying drawings and described in the description given hereinafter. The remainder of the apparatus can be constructed according to the teachings of the art which are well known to the expert. Referring firstly to FIGS. 1 and 2, these represent very diagrammatic views of apparatus, indicated overall by 10, for joining textile threads with the aid of compressed air. The apparatus 10 comprises a mixing chamber 11 formed in a block 12 which is open at its two sides and at its front where it can be closed in a sealed manner by means of a cover 13. A conduit 14 originating from a source of compressed air opens into the chamber 11, and has connected into it a shut-off valve 15 which enables a burst of compressed air to be fed into the chamber 11 for a predetermined time in order to join two threads 16, 17 by mixing and interlacing their fibres.

Locking means, indicated diagrammatically by 18 and 19, are provided at the points at which the threads to be joined 16, 17 enter the apparatus.

The difference between the apparatus of FIG. 1 and the apparatus of FIG. 2 is that in the former the two threads 16 and 17 enter the apparatus 10 both from the same side thereof, so that the locking means 18, 19 are also on the same side, whereas in the apparatus of FIG. 2 the threads 16, 17 enter from opposite sides and the locking means 18, 19 are consequently on opposite sides of the apparatus.

FIGS. 1 and 2 show diagrammatically the situation in which the two threads 17, 16 are still in the mixing chamber 11 which is closed at its front by the cover 13, but have already been joined together in the zone indicated by 26, this situation therefore immediately following the joining stage. The threads 16, 17 are still locked at the point where they enter the apparatus 10 by the locking means 18 and 19. The shut-off valve 15 is closed.

It is at this moment, before the joined threads are extracted from the apparatus 10, in which the checking device according to the invention acts.

In the case illustrated, this device comprises two mobile hook members 20, 21 arranged to exert a predetermined traction force on the loop formed by the joined threads at two intermediate points adjacent to their respective points of exit from the mixing chamber 11 and between their points of entry into the apparatus where the locking means 18 and 19 respectively are located, this traction force tending to unfasten the joint 26 which has been made.

Each of the mobile members 20, 21 is provided with a control member indicated diagrammatically in FIGS. 1 and 2 as constituted by a swivel-mounted lever 22 and 23 respectively, operated by means, not shown, to make a rotation through a predetermined angle firstly in the direction of the arrow and then in the return direction. The lever 22 or 23 acts on the respective mobile member 20 or 21 not directly, but by way of a yieldable coupling indicated diagrammatically as constituted by a spring 24 and 25 respectively.

From the aforegoing, it is apparent that when the levers 22 and 23 rotate in the outward direction (in the direction of the arrows), the springs 24, 25 become loaded and the load is transmitted by way of the hook members 20, 21 to the loop formed by the joined threads which are locked between the means 18, 19. Now if the joint 26 between the threads 16, 17 is perfect, i.e. if it resists the predetermined traction force, the members 20, 21 remain at rest and the springs 24, 25 are simply compressed, thus enabling the levers 22, 23 to carry out their entire outward stroke. The levers then return to their rest position and the joint 26 has passed the test. The joined threads can be extracted from the apparatus, with the certainly that the joint zone 26 withstands a predetermined traction force.

If however the joint 26 between the threads 16, 17 is defective, the members 20, 21 under the thrust of the springs 24, 25 begin to move in the direction of the arrows and tear the threads 16, 17 in their joint zone 26. The stroke of travel of the members 20, 21 which they are made to undergo by the rotation of the levers 22, 23 is such that the defective joint becomes reliably destroyed, i.e. that the threads 16, 17 become reliably separated from each other, thus preventing imperfectly joined threads from being able to be extracted from the apparatus. In this case, the joining operation must obviously be repeated.

One embodiment of an apparatus of the type shown in FIG. 1 provided with the checking device according to the invention is described hereinafter with reference to FIGS. 3 and 4.

The apparatus 10 again comprises the parts shown diagrammatically in FIG. 1, namely the mixing chamber 11 in the block 12, and the cover 13.

The conduit feeding the compressed air to the chamber 11 and the shut-off valve are not shown. Locking members 18, 19 are provided for the threads 16, 17 at the points in which they enter the apparatus 10.

On the body of the apparatus 10 to the two sides of the block 12 there are provided pins 30, 31 about which crank levers 32, 33 respectively are rotatably mounted and are rigid at one end with bushes 34, 35 mounted on respective pins 30, 31, while at their other end they comprise beak-shaped portions 36, 37 which match the shape of the block 12 when in their rest position. In a plane parallel to the plane of the levers 32, 33, the bushes 34, 35 carry arms 38, 39 which are hinged by pins 40, 41 to a forked end 42, 43 of rods 44, 45. On these rods are mounted two sleeves 46, 47 and 48, 49 respectively, which are telescopically slidable relative to each other by way of a spring 50, 51 respectively. The outer sleeve 46, 48 respectively abuts against the forked end 42, 43 respectively of the relative rod 44, 45. The rods 44, 45 comprise central longitudinal through slots 52, 53, and at their ends distant from the forked ends they carry stops 54, 55. The heads 56, 57 of levers 58, 59 fixed to a common shaft 60 rotatably mounted in the body of the apparatus are inserted through the slots 52, 53. The heads 56, 57 are located between the inner sleeve 47, 49 respectively and the stop 54, 55 respectively of the relative rod 44, 45.

An arm 61 is fixed on the shaft 60 at one side of the apparatus (see FIG. 4) and carries at its end a roller 62 which is inserted in a profiled cam groove 63 provided in the front of a disc 64 rigid with the drive shaft 65 of the apparatus which rotates in the direction of the arrow of FIG. 4.

The profiled groove 63 has a circular profile 66 over a certain angular sector, followed by a descending portion 67, which itself is followed by a portion 68 which rises towards the circular profile.

When the roller 62 of the arm 61 is in the circular profile portion 66, the levers 58, 59 are rotated into the position indicated in FIGS. 3 and 4. This is the rest position of the checking device, which is assumed during the entire joining cycle carried out by the apparatus. In this position, the beak-shaped portions 36, 37 are kept adhering to the block 12.

At the end of the joining cycle, with the cover 13 still in its closure position and with the members 18, 19 still locking the threads 16, 17 at the points in which they enter the apparatus, the joint zone 26 of the two threads 16, 17 is in the mixing chamber 11, and the checking device comes into operation under these conditions. The roller 62 of the arm 61 enters the descending portion 67 of the groove 63 so that it causes the levers 58, 59 to rotate in an anticlockwise direction (with reference to FIG. 4). The heads 56, 57 of the levers 58, 59 act on the inner sleeve 47, 49, and urge them towards the left, so compressing the respective springs 50, 51. A thrust is thus exerted on the forked end 42, 43 of the rods 44, 45, which tends to rotate the arms 38, 39 and the levers 32, 33 in the direction which seeks to withdraw the beak-shaped portions 36, 37 from the block 12. In this manner, a predetermined force tending to tear the thread joint 26 becomes exerted by the beak-shaped portions 36, 37 on the joined threads 16, 17 which pass to the side of said beak-shaped portion 36, 37.

If the joint zone 26 withstands this traction force, the beak-shaped portions 36, 37 are held by the threads 17, 16 close to the block 12, and rotation of the units 32, 38 and 33, 39 respectively is prevented, with the result that the rods 44, 45 with their outer sleeves 46, 48 are also held at rest. However, the levers 58, 59 can still carry out their predetermined rotation, by simply displacing the inner sleeves 47, 49 and compressing the springs 50, 51. When the roller 62 enters the rising portion 68 of the profiled groove 63, the levers 58, 59 are rotated in the direction opposite to the preceding, and the inner sleeves 47, 49 return to their initial position under the thrust of the respective springs 50, 51.

The joint 26 has thus overcome the traction test, and the apparatus 10 can complete its working cycle during which the cover 13 is opened, the threads 16, 17 are released by the locking members 18, 19, and the joined threads are extracted.

If however the joint zone 26 proves defective to the extent of not withstanding the traction force applied to the joined threads by the beak-shaped portions 36, 37, then the units 32, 38 and 33, 39 respectively, under the thrust of the levers 58, 59 and by way of the springs 50, 51, begin to rotate and the beak-shaped portions 36, 37 are withdrawn from the block 12, thus tearing the joint 26 and separating the two threads 16, 17.

The rotation imparted to said units 32, 38 and 33, 39 and thus to the beak-shaped portions 36, 37 is such as to ensure complete separation of the two threads 16, 17, and to reliably unfasten the defective joint.

The checking device then returns to its rest position, and the apparatus completes its operating cycle, but the threads 16, 17 are not joined together when extracted from the apparatus with the result that the entire joining operation has to be repeated.

The characteristics and advantages attained by the checking device of the invention are apparent from the aforegoing description.

It ensures that the joined threads extracted at the end of the working cycle of the apparatus are able to resist at least a predetermined traction force in their joint zone, whereas if this resistance is not attained then it unfastens the defective joint and separates the threads.

No additional operations are required in effecting this check and providing said guarantee, and in fact the checking stage is fitted into the operating cycle of the apparatus, In the embodiments illustrated, the predetermined traction force with which the check is carried out is fixed and is determined by the setting of the springs 50, 51. If the value of this force is to be varied, then the two springs must be changed. However, suitable means can be provided for adjusting the spring loading.

It should also be noted that the yieldable couplings disposed between the control means (levers 58, 59) and mobile members (rods 44, 45 and swivel-mounted units 32, 38 and 33, 39), which in the described embodiment are constituted by springs 50, 51 and telescopic sleeves 46, 47 and 48, 49, can also be constituted by other suitable means, such as friction clutches and the like.

We claim:

1. An apparatus for joining textile threads with the aid of compressed air, provided with a mixing chamber, means for feeding a burst of compressed air into said chamber for a predetermined time, and means which during the joining operation lock the threads to be joined at the points in which they enter the apparatus, characterised by incorporating a device for checking the tearing strength of the joint zone of the two threads comprising at least one mobile member arranged to act on the loop formed by the joined threads with a predetermined traction force at an intermediate point between the locking points at the apparatus inlet, control means for said mobile member which are operated so that they travel through a predetermined outward and return stroke, and a yieldable coupling disposed between said mobile member and said control means, said joint being set to yield when said predetermined traction force is exceeded.

2. An apparatus as claimed in claim 1, characterised in that the checking device comprises two mobile members with respective control means and yieldable couplings which act at different points on the loop formed by the joined threads between the locking point at the apparatus inlet, and said control means are connected together and operated simultaneoudly.

3. An apparatus as claimed in claim 2, characterised in that said mobile members act on the loop formed by the joined threads in the vicinity of the thread outlets from the mixing chamber.

4. An apparatus according to claim 3, characterized in that the mobile members are hook-shaped.

5. An apparatus as claimed in claim 4, characterized in that each mobile member is constituted by a crank lever swivel-mounted on the body of the apparatus, said lever carrying a hook in the vicinity of one outlet of the mixing chamber and being connected to a control lever by way of a yieldable coupling.

6. An apparatus as claimed in claim 5, characterized in that to said crank lever there is connected a rod on which two telescopic sleeves are mounted concentrically, a spring being disposed between one of said sleeves, which is kept adhering to a stop on said rod, and the other sleeve, on which the end of the control lever acts.

7. An apparatus as claimed in claim 6, characterized in that the control lever is fixed on a shaft mounted rotatably in the body of the apparatus, said shaft being rigid with an operating arm carrying a roller which is engaged with a profiled groove cam fixed on the apparatus drive shaft.

8. An apparatus as claimed in claim 1, characterized in that means are provided for adjusting the setting of said yieldable coupling.

* * * * *

UNITED STATES PATENT AND TRADEMARK OFFICE

CERTIFICATE OF CORRECTION

PATENT NO. : 4,437,299

DATED : March 20, 1984

INVENTOR(S) : Ferdinando Truzzi and Mauro Premi

It is certified that error appears in the above-identified patent and that said Letters Patent is hereby corrected as shown below:

Claim 1, penultimate line, "joint" should read -- Yieldable coupling --.

Signed and Sealed this

*Twenty-third* Day of *October 1984*

[SEAL]

*Attest:*

GERALD J. MOSSINGHOFF

*Attesting Officer*

*Commissioner of Patents and Trademarks*